United States Patent [19]

Jaeger

[11] Patent Number: 5,064,979

[45] Date of Patent: Nov. 12, 1991

[54] MICROWAVE AIR FLOAT BAR FOR DRYING A TRAVELING WEB

[75] Inventor: Hugh D. Jaeger, Deephaven, Minn.

[73] Assignee: W. R. Grace & Co.-Conn., New York, N.Y.

[21] Appl. No.: 489,902

[22] Filed: Aug. 7, 1990

[51] Int. Cl.[5] ..... H05B 6/78

[52] U.S. Cl. ..... 219/10.55 A; 219/10.55 F; 34/1; 34/156

[58] Field of Search ..... 219/10.55 A, 10.55 R, 219/10.55 F, 10.61 R; 34/1, 156, 155, 4

[56] References Cited

U.S. PATENT DOCUMENTS

| | | | |
|---|---|---|---|
| 3,242,304 | 3/1966 | Hickman | 219/10.55 A |
| 3,426,439 | 2/1969 | Ryman et al. | 34/1 |
| 3,725,627 | 4/1973 | Arai | 219/10.55 A |
| 3,739,130 | 6/1973 | White | 219/10.55 A |
| 3,764,768 | 10/1973 | Sayer, Jr. | 219/10.55 A |
| 3,851,132 | 11/1974 | Van Koughenett | 219/10.55 A |
| 3,873,013 | 3/1975 | Stibbe | 34/156 |
| 4,091,252 | 5/1978 | Koinuma | 219/10.55 R |
| 4,234,775 | 11/1980 | Wolfberg et al. | 219/10.55 A |
| 4,257,167 | 3/1981 | Grassman | 34/1 |
| 4,350,859 | 9/1982 | Dudley et al. | 219/10.55 F |
| 4,593,168 | 6/1986 | Amada | 219/10.55 A |
| 4,638,571 | 1/1987 | Cook | 34/1 |
| 4,901,449 | 2/1990 | Wimberger | 34/156 |

*Primary Examiner*—Philip H. Leung

*Attorney, Agent, or Firm*—Hugh D. Jaeger

[57] ABSTRACT

Microwave air float bar for use in floating and drying a continuous planar web of a material in a dryer. Radiated microwave radio frequency energy from a microwave in an air bar accelerates drying, or evaporation of solvents, or curing of planar web material passing in proximity to the microwave air float bar either by microwave radio frequeny energy, or in combination with Coanda air flow.

8 Claims, 7 Drawing Sheets

MICROWAVE AIR FLOAT BAR FOR DRYING A TRAVELING WEB

BACKGROUND OF THE INVENTION

1. Field of the Invention

The present invention relates to a microwave air float bar for use in positioning, drying or curing of a continuous planar flexible material such as a web, web of paper, news print, film material, or plastic sheet. The present invention more particularly, pertains to a microwave air float bar whose pressure pad area includes a means of radiating radio frequency microwave energy to enhance accelerated ultraviolet heating of a web material to cause solvent evaporation, drying or curing. Microwave radio frequency energy in combination with columns of heated air impinging upon the web surface provides for concentrated heating of the web material thereby providing subsequent rapid evaporation, drying or curing from the surface of the material.

2. Description of the Prior Art

Demand for increased production volume and production speed of web material in dryers has caused the processing industry to increase web speed on their production lines. Typically this speed-up requirement results in the dryer being inadequate in drying the web, because the web did not remain in the dryer adjacent to a series of air bars for a sufficient length of time to dry the web because of the increased web speed. The solution for adequate drying was to either replace the entire dryer with a longer dryer, or to add additional drying zones in series with a first dryer zone. This, of course, is expensive and often times not feasible due to a shortage of physical floor space.

The present invention overcomes the disadvantages of the prior art dryers by providing a microwave air float bar to replace existing air float bars in web dryers. In addition to air flow of dry air from the Coanda air flow slots at the upper and outer extremities of the air float bar, a magnetron is located between the Coanda air flow slots, and transmits microwave radio frequency electromagnetic radiation waves to the traversing web. The traversing web drying is accomplished by impingement of a combination of both heated Coanda air flow and microwave radio frequency electromagnetic energy radiation. The combined concentration of heat from the Coanda air flow and the microwave radio frequency electromagnetic energy radiation from the magnetron is of a sufficient magnitude which allows the web to dry at a higher speed than normal prior art speed.

To a limited extent, the use of microwave energy to improve dryer efficiency has been taught in the art. U.S. Pat. No. 4,234,775 issued to Wolfberg, et al. teaches a relatively modern technique. U.S. Pat. Nos. 3,739,130; 3,764,768; 3,725,627; and 3,851,132 issued to White, Sayer, Arai, and VanKoughnett, respectively, teach earlier methods. In none of these references is the microwave radiator combined with an air stream to support the web, as well as cool the microwave generator and further heat the web material.

SUMMARY OF THE INVENTION

The general purpose of the present invention is to provide an air float bar for use in the drying of webs in a dryer, and more particularly, provides an air float bar which includes a magnetron integrated into the air float bar for the generation and transmission of microwave radio frequency electromagnetic energy radiation by itself or in combination with Coanda air flow upon a web traversing through the dryer. The magnetron is located between the Coanda air flow slots and at the point of highest heat transfer, namely between the Coanda air flow slots. Microwave radio frequency electromagnetic energy passes in a straight forward, direct manner to impinge upon a traversing web.

According to one embodiment of the present invention, there is provided an air bar with an integral magnetron for the drying of a traversing web in a drying system. An air bar header member provides the framework for support and includes V or like channels on each side for the inclusion of an internal diffusion plate. Lips on the upper portion of the air bar header form one edge of Coanda slots, and a fixed position channel member with Coanda curves forms the other portion of the Coanda slots. Oval air supply inlets on the bottom of the air bar header provide air flow for the Coanda slots. One significant aspect and feature of the present invention is an air float bar containing an integral magnetron between Coanda slots where the combination of Coanda air flow and microwave radio frequency electromagnetic energy drys the traversing web. The traversing web is dried with either Coanda air flow, microwave radio frequency electromagnetic energy radiation, or a combination of Coanda air flow and microwave radio frequency electromagnetic energy radiation.

Another significant aspect and feature of the present invention is an air float bar which offers an increased heat transfer rate per size of the air bar unit which is a practical alternative solution to increasing production requirements.

Still another significant aspect and feature of the present invention is direct radiation of microwave radio frequency electromagnetic energy to impinge upon a traversing web in a dryer.

A further significant aspect and feature of the present invention is a microwave air float bar that can be used to dry products that require high controlled heat and non-contact support. The microwave air float bar can be used in curing of preimpregnated products such as polymer coatings that require airing, and are affected by high air impingement rates. The microwave air float bar can also be used for drying of low solids, and water based coatings that are sensitive to high air impingement during the first stages of drying process. The microwave air float bar can also be used for drying of water based coatings on steel strip webs which require high controlled heat loads. The microwave air float bar is useful for drying webs that cannot endure high temperatures, and that experience frequent web stops. Because of the ability to switch the microwave radio frequency energy on or off almost instantly, the air bars can be run with cold convection air for support, and the magnetron can be used as the only heat source.

Having thus described embodiments of the present invention, it is a principal object hereof to provide a microwave air float bar for the drying of a traversing web in a dryer.

One object of the present invention is a microwave air float bar which features the use of Coanda air flow with microwave radio frequency electromagnetic energy.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
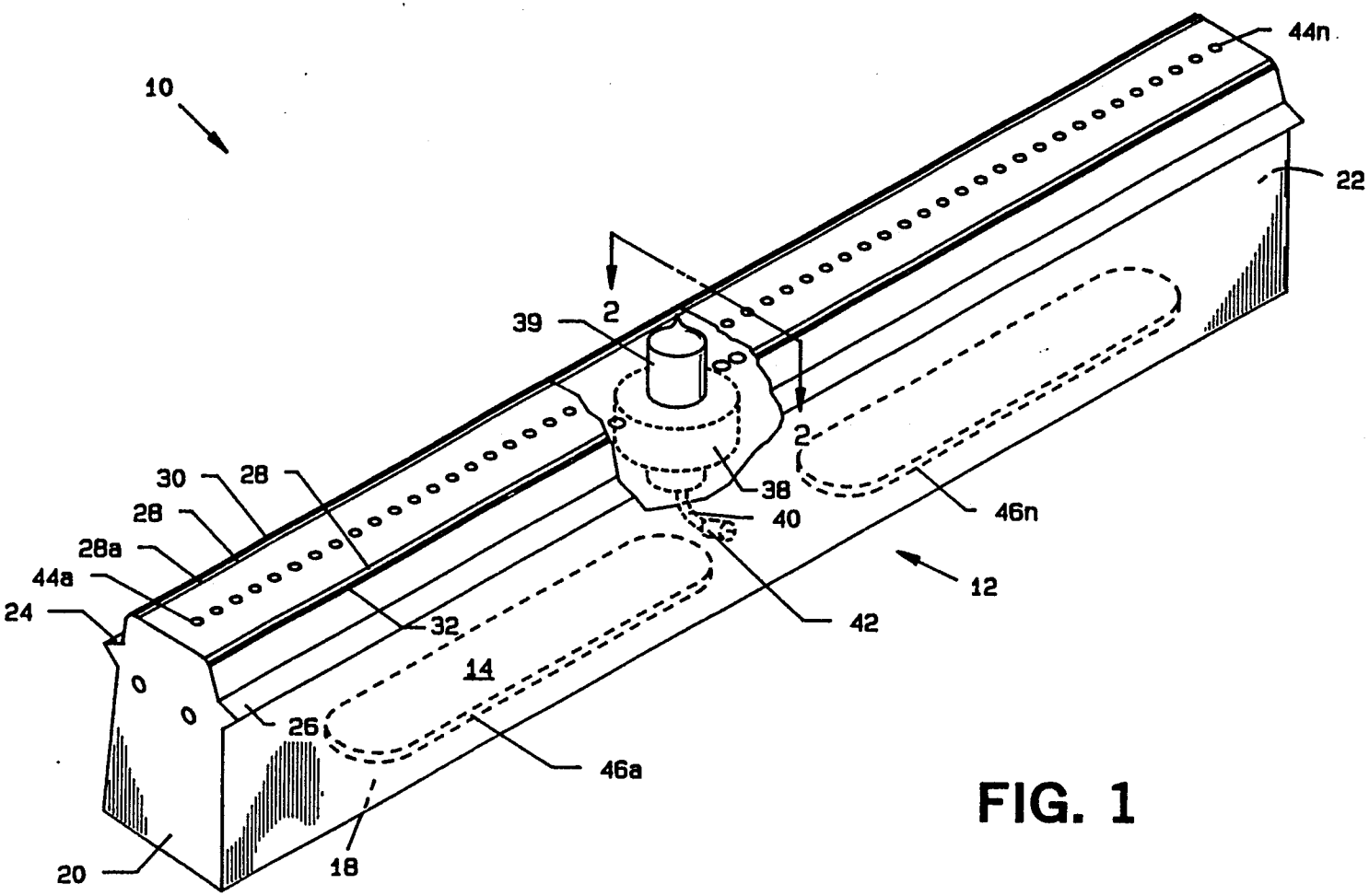
FIG. 1 illustrates a perspective view of the microwave air float bar, the present invention.
Figure 2:
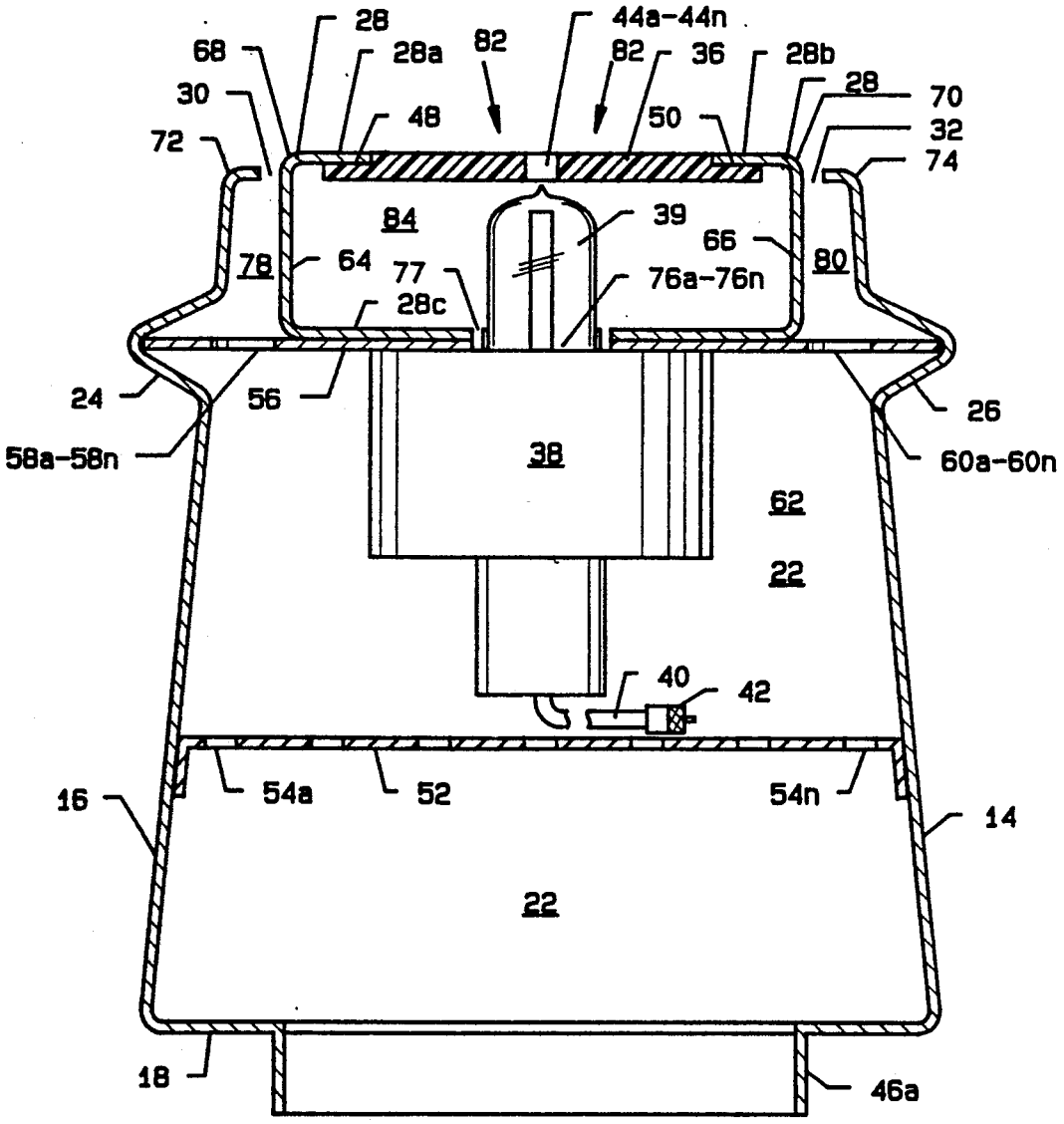
FIG. 2 illustrates a cross-sectional view of the microwave air float bar taken along line 2—2 of FIG. 1.

FIG. 1 illustrates a perspective view of a microwave air float bar 10, the present invention, for use in drying a web in a web dryer. Externally visible members of the microwave air float bar 10 include a channel like air bar header 12 with opposing sides 14 and 16, a bottom 18, and opposing and parallel ends 20 and 22 affixed between sides 14 and 16. V channels 24 and 26 are formed and aligned horizontally in sides 14 and 16 to accommodate an air bar mounting flange as later described in detail. V channels 24 and 26 are also illustrated in FIG. 2. An air bar channel/wave guide 28, which acts as a wave guide, aligns longitudinally in a precise manner between the upper regions of sides 14 and 16 to provide for forming longitudinally aligned and uniformly sized Coanda slots 30 and 32 as later described in detail. A rectangular shaped transparent member 36 consisting of quartz or polymer is located between the opposing air bar channel upper ends 28*a*–28*n* and extends the length of the air bar channel/wave guide 28. A magnetron 38, radiates electromagnetic energy in the microwave region. Reflector 37 is parabolic along both lateral and longitudinal axis to distribute microwave energy along the length of the transparent member 36 and in the air bar channel/wave guide 28. A coaxial cable 40 and connector 42 supplies magnetron 38. A plurality of holes 44*a*–44*n* extend along the center line of the circuit board to allow upward forced air flow between the Coanda slots 30 and 32. A plurality of oval shaped air inlets 46*a*–46*n* position on the bottom surface 18 of the air bar header 12 to supply drying air through the air bar header 12 and to the Coanda slots 30 and 32.

Figure 3:
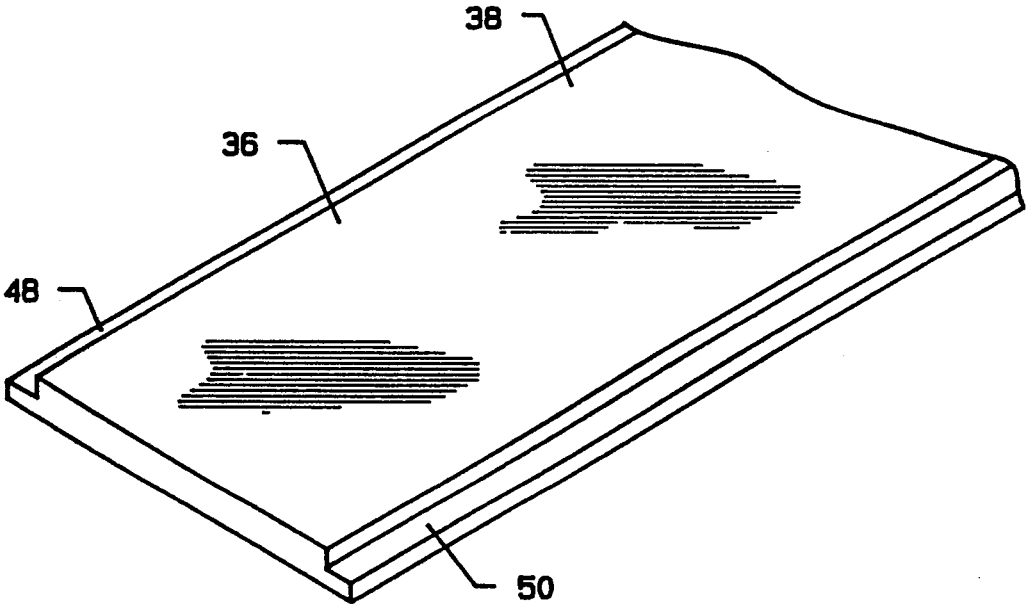
FIG. 3 illustrates a cross-sectional end view of the mode of operation of the microwave air float bar.

FIG. 2 illustrates a cross-sectional view of the microwave air float bar 10 taken along line 2—2 of FIG. 1 where all numerals correspond to those elements previously described. Transparent member 36 is transparent energy in the microwave region. Transparent member 36, the magnetron 38, including a magnetron tube 39, and reflector 37, are secured by bonding, screwing, or other suitable means to the air bar channel/wave guide 28 between the horizontal air bar channel ends 28*a* and 28*b*. The transparent member 36 includes longitudinal dado like cutout areas 48 and 50 which accommodate the air bar channel ends 28*a* and 28*b* to form a smooth transition between the air bar channel/wave guide 28 and the transparent member 36 containing the magnetron 38. A diffuser plate 52 with a plurality of holes 54*a*–54*n* secure between sides 14 and 16 to provide for even flow of drying air from the plurality of oval shaped air inlets 46*a*–46*n*. A support plate 56 positions between V channels 24 and 26, and includes a plurality of holes 58*a*–58*n* and 60*a*–60*n* extending longitudinally along the support plate 56 and parallel to the V-channels 24 and 26, respectively. The plurality of holes 58*a*–58*n* and 60*a*–60*n* align longitudinally in two opposing rows along the outer regions of the support plate 56. The bottom 18, sides 14 and 16, ends 20 and 22, and the diffuser plate 52 define a first chamber 61. The diffuser plate 52, sides 14 and 16, ends 20 and 22, and the support plate 56 define a second chamber 62. The fixed air bar channel/wave guide 28 secures by welding or other suitable attachment to the support plate 56, and includes sides 64 and 66, Coanda curves 68 and 70, and horizontal planar air bar channel ends 28*a* and 28*b* at right angles to sides 64 and 66. Angled and curved lips 72 and 74, extensions of sides 16 and 14, extend inwardly at right angles to form Coanda slots 30 and 32 between the ends of angled and curved lips 72 and 74 and Coanda curves 68 and 70, respectively, each slot being of a finite size. A plurality of holes 76*a*–76*n* extend through the center line and longitudinally along the bottom portion 28*c* of the air bar channel/wave guide 28 and the support plate 56 as illustrated in FIG. 3. Another hole 77 through the bottom portion 28*c* of the air bar channel/wave guide 28 and the support plate 56 accommodates the magnetron tube 39. Chamber 78 is formed by the fixed air bar channel/wave guide side 64, the outer portion of support plate 56, the upper portion of side 16 and the angled and curved lip 72. In a similar fashion, chamber 80 is formed by the fixed air bar channel side 66, the outer portion of support plate 56, the upper portion of side 14 and the angled and curved lip 74. The area between the Coanda slots 30 and 32, known as the pressure pad 82, includes the transparent member 36 and the magnetron 38, air bar/wave guide channel ends 28*a* and 28*b* and Coanda curves 68 and 70. Another chamber 84 is formed by the interior surfaces of air bar channel sides 64 and 66, air bar channel bottom 28*c*, and by the transparent member 36.

While a single magnetron 38 is illustrated, a plurality of magnetron members can be used for applications requiring yet even more microwave radio frequency magnetic energy radiation. Larger microwave air float bar assemblies can include multiple parallel magnetron members to transmit microwave radio frequency electromagnetic energy radiation to a traversing web.

FIG. 3 illustrates a perspective view of the transparent member 36. Illustrated in particular are the cutout areas 48 and 50 extending longitudinally along and about the edges of the transparent member 36. All numerals correspond to those elements previously described.

Figure 4:
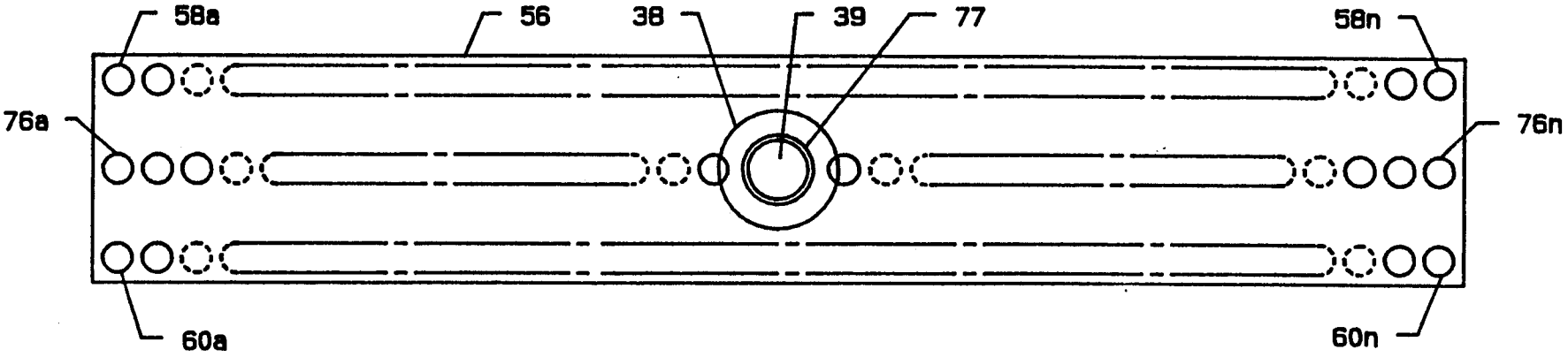
FIG. 4 illustrates a top view of the support plate.

FIG. 4 illustrates a top view of the support plate 56 where all numerals correspond to those elements previously described. Illustrated in particular are the plurality of holes 76*a*–76*n* extending longitudinally along the centerline of the plate 56. Hole 77 is centrally located to accommodate the magnetron tube 39. Pluralities of holes 58*a*–58*n* and 60*a*–60*n* extend longitudinally along the edges of the support plate 56 for allowance of drying air into chambers 78 and 80 from chamber 62 as illustrated in FIG. 2. Holes 76a–76n allow drying air to enter chamber 84 from the underlying chamber 62.

MODE OF OPERATION

Figure 5:
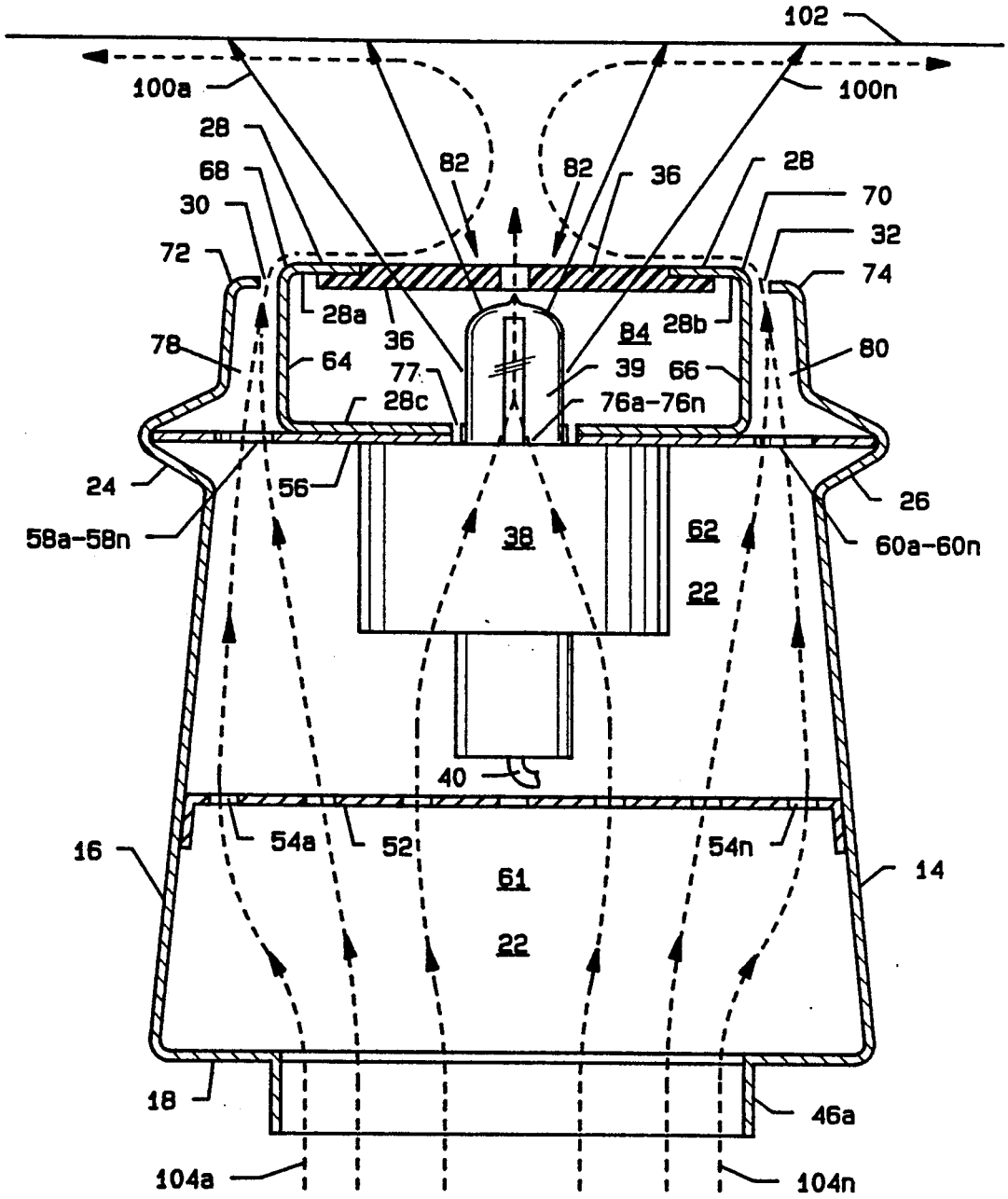
FIG. 5 illustrates the microwave energy and air flow in the microwave air float bar.

FIG. 5 best illustrates the mode of operation of the microwave air float bar 10 where all numerals correspond to those elements previously described. A plurality of microwave radio frequency electromagnetic energy waves 100a–100n radiated by the magnetron tube 39 increase drying capacity because the magnetron tube 39 is located at the point of highest heat transfer, namely between the Coanda slots 30 and 32, and radiate from the magnetron tube 39 directly to and impinge upon a web 102. The microwave radio frequency drying energy waves 100a–100n are transmitted for heating a traversing web 102 being processed in a dryer. The wave length of the microwave radio frequency electromagnetic waves 100a–100n emitted from the magnetron 38 is chosen to correspond to the absorbtion pattern of the material of web 102. The magnetron tube 39 is positioned at a point of maximum energy transfer.

Pressurized air to float the web 102 enters the microwave air float bar 10 through the plurality of oval shaped air inlets 46a–46n to float the web 102 above the pressure pad 82. From the oval shaped air inlets 46a–46n, the pressurized air particles 104a–104n flow proceeds as indicated by dashed arrow lines through the first chamber 61, through holes 54a–54n of the diffuser plate 52, into the second chamber 62, through the pluralities of holes 58a–58n, 60a–60n and holes 76a–76n of the support plate 56, through chambers 78 and 80, through the Coanda slots 30 and 32 along Coanda curves 68 and 70, and then inwardly along the upper surface of the transparent member 36 and upwardly, thus providing float lift for the web 102 and also carrying away solvent vapors in the web. Air passing through holes 76a–76n enter chamber 84 and exit through the plurality of holes 44a–44n to aid and assist in air drying of the web 102. Microwave radio frequency energy waves 100a–100n impinge directly on the web 102 and heat the web 102 as it passes over the pressure pad 82, thus drying and evaporating solvents from the web 102. This, in combination with impinging flow of air particles 104a–104n, maximizes the heat transfer in the area of the pressure pad 82.

The duty cycle of the magnetron 38 can be variably controlled, so that the amount of microwave radio frequency energy output transmitted from the magnetron tube 39 includes a range from full power to no power, and any variable range therebetween.

DESCRIPTION OF THE ALTERNATIVE EMBODIMENTS

Figure 6:
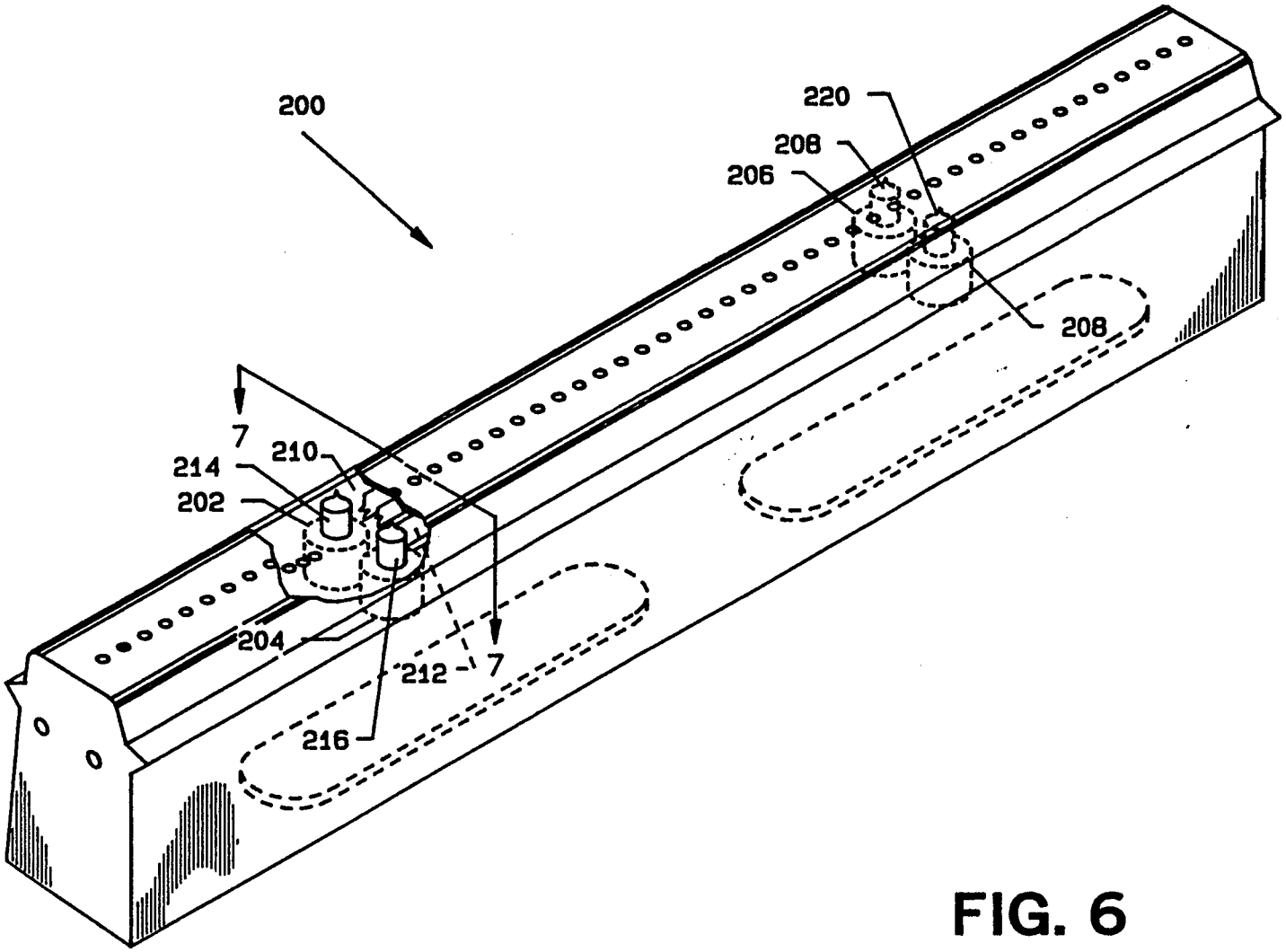
FIG. 6 illustrates an alternative embodiment of the microwave air float boar incorporating a plurality of magnetrons; and, FIG. 7 illustrates a cross section of the microwave air bar taken along line 7-7 of FIG. 6.

FIG. 6 illustrates an alternative embodiment in cutaway perspective of a microwave air float bar 200 with a plurality of magnetrons 202, 204, 206 and 208 and a corresponding plurality of reflectors 20!, 203, 205 and 207. Magnetrons 202 and 206 supply microwave radio frequency energy to a left wave guide structure 210, and magnetrons 204 and 208 supply microwave radio frequency energy to a right wave guide 212. The encompassing or surrounding structures are similar to those described in FIGS. 1–6 with the exception of the addition of separate wave guides as illustrated in FIG. 8. Magnetrons 202–208 include magnetron tubes 214, 216, 218 and 220. A greater amount of microwave radio frequency electromagnetic energy may be distributed more evenly and in a greater amount over a wide air bar when this arrangement is utilized, resulting in more efficient and faster web drying.

Figure 7:
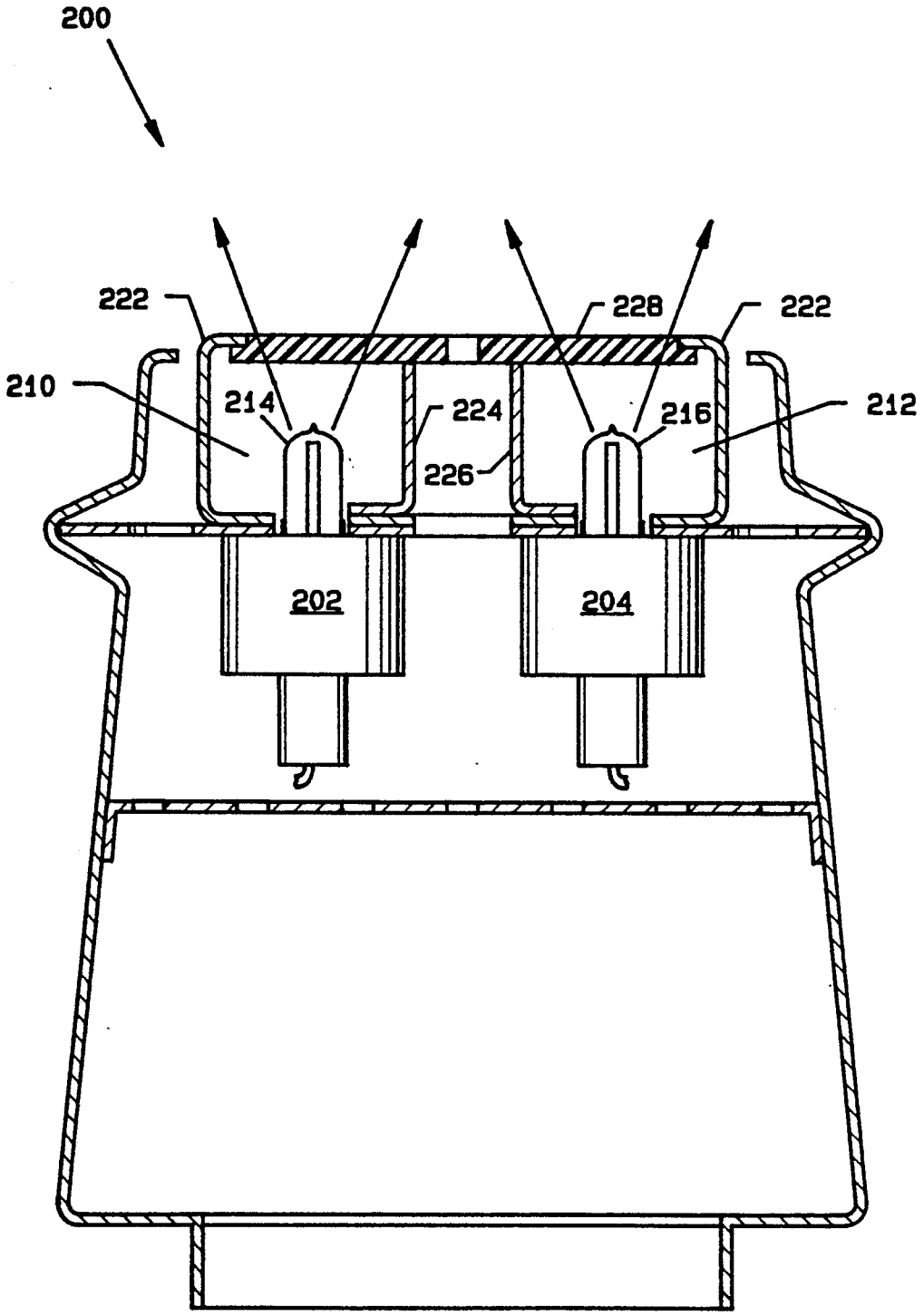

FIG. 7 illustrates a sectional end view taken along line 7—7 of FIG. 6. Illustrated in particular are the magnetrons 202 and 204 and respective magnetron tubes 214 and 216. Magnetron tubes 214 and 216 reside in the left and right wave guide structures 210 and 212, respectively. The wave guide structure 210 is formed by the air bar channel 222 and an angled member 224. The wave guide structure 212 is formed by the air bar channel 222, and an angled member 226. Air passes as previously described through the encompassing orifices. Microwave radio frequency electromagnetic energy is emitted from the magnetron tubes 214, 216, 218 and 220 and wave guides 210 and 212 through a transparent member 228.

Various modifications can be made to the present invention without departing from the apparent scope thereof.

We claim:

1. Apparatus for drying a traveling web of material comprising:

a. an air bar housing with a substantially planar top surface, a portion of said substantially planar top surface transparent to microwave energy;

b. a source of a pressurized gas coupled to said housing;

c. a coanda slot nozzle means on each side of said housing and connected to said source of said pressurized gas for supporting said traveling web of material by directing a portion of said pressurized gas into contact with said traveling web of material; and, d. microwave energy means within said housing and below said transparent portion of said top surface for radiating said traveling web of material with electromagnetic radiation in the microwave region through said portion of said substantially planar top surface transparent to microwave energy.

2. Apparatus according to claim further comprising means coupled to said source of said pressurized gas and said radiating means for controlling the temperature of said radiating means by directing a portion of said pressurized gas into contact with said radiating means.

3. Apparatus according to claim 2 wherein said radiating means further comprises a magnetron.

4. Apparatus according to claim 3 wherein said radiating means further comprises a reflector.

5. Apparatus according to claim 4 wherein said reflector is parabolic along two axis.

6. Apparatus according to claim 1 further comprises means for directing said electromagnetic radiation in the microwave region.

7. Apparatus according to claim 6 wherein said directing means further comprises a wave guide.

8. Microwave air float bar for drying a traveling web of material comprising:

a. an air float bar with a substantially planar top surface a portion of said substantially planar top surface transparent to microwave energy;

b. a source of a pressurized gas coupled to said housing;

c. a coanda slot nozzle means on each side of said housing and connected to said source of said pressurized gas for supporting said traveling web of material by directing a portion of said pressurized gas into contact with said traveling web of material; and, d. microwave energy means within said housing, below said transparent portion of said top surface and between said coanda slot nozzles, for radiating said traveling web of material with electromagnetic radiation in the microwave region through said portion of said substantially planar top surface transparent to microwave energy.

* * * * *